United States Patent [19]

Rabner

[11] 4,191,306

[45] Mar. 4, 1980

[54] STAMP DISPENSER

[76] Inventor: Walter P. Rabner, 13861 Fresh Meadow, Apartment 1-H, Seal Beach, Calif. 90740

[21] Appl. No.: 4,749

[22] Filed: Jan. 19, 1979

[51] Int. Cl.[2] ..... B65H 1/00

[52] U.S. Cl. ..... 221/33; 206/39.7; 312/50

[58] Field of Search ..... 206/39.3, 39.7, 39; 132/79 D; 312/50; 225/32; 221/303, 309, 33; 211/50

[56] References Cited

U.S. PATENT DOCUMENTS

| | | | |
|---|---|---|---|
| 374,509 | 12/1887 | Thum | 206/39 |
| 1,072,859 | 9/1913 | Kingsley | 206/39 X |
| 1,285,240 | 11/1918 | Krile | 206/39.3 |
| 2,347,823 | 5/1944 | Goodman et al. | 312/50 |
| 2,847,118 | 8/1958 | Johnson | 206/39.3 |
| 3,456,842 | 7/1969 | Mierson | 221/33 |
| 3,878,966 | 4/1975 | Haboush | 221/33 |

*Primary Examiner*—Allen N. Knowles
*Attorney, Agent, or Firm*—William C. Babcock

[57] ABSTRACT

Disclosed herein is a dispensing clip for retaining in folded pack up a plurality of stamps and for dispensing the retained stamps one-by-one. More specifically the clip is generally conformed to include two inwardly directed free edges extending from a center section, each convolved over an inwardly directed bend, the separation between the bends being less than the lateral dimension of the stamps. The stamps may then be placed in accordian folds on the interior of the clip and as one stamp is withdrawn the next stamp is made available for use.

3 Claims, 4 Drawing Figures

FIG. 1
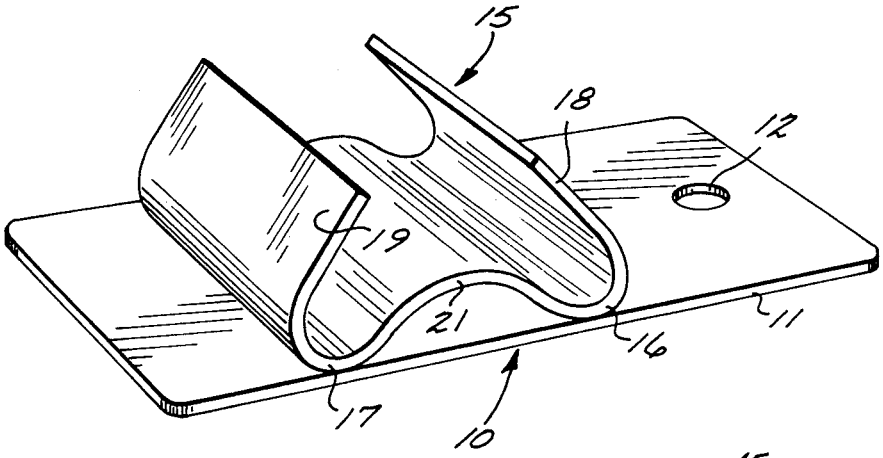
FIG. 2
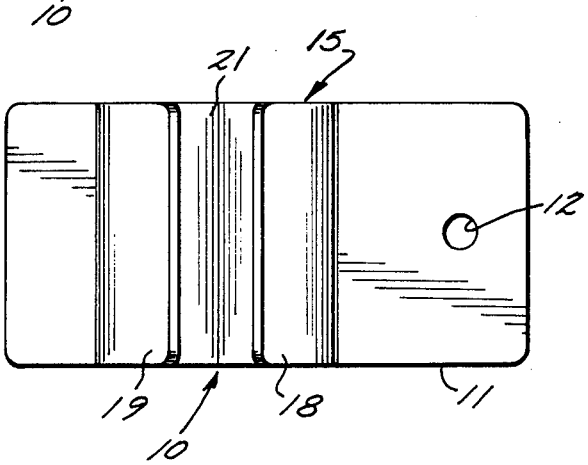
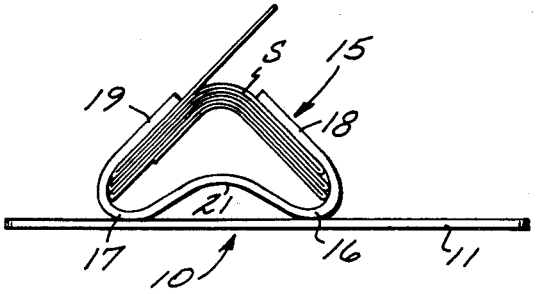
FIG. 3
FIG. 4
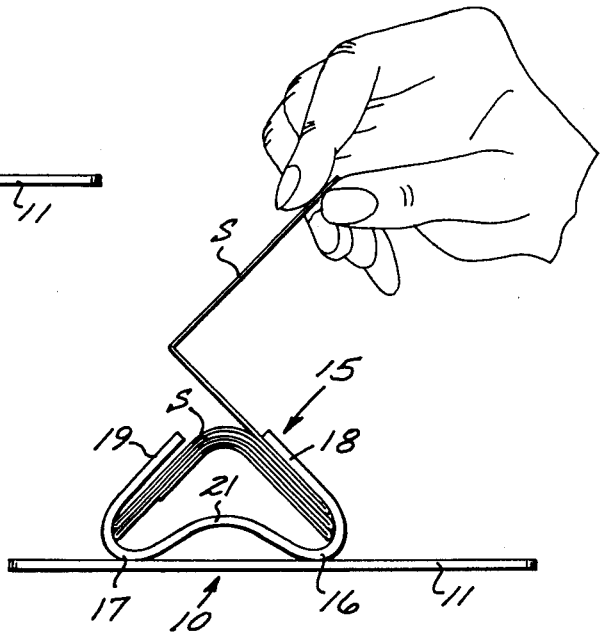

STAMP DISPENSER

BACKGROUND OF THE INVENTION

1. Field of the Invention

The present invention relates to dispensing devices, and more particularly to devices for dispensing stamps.

2. Description of the Prior Art

Reserves of postage stamps of various denominations are quite frequently stored in homes and offices for anticipated correspondence. Most typically such postage stamps are stored in a drawer or other container in loose form or in a roll. In each instance as the stamps are used, the remainder becomes more and more disorganized with the eventual destruction of some stamps and loss through disorganization. To assist and organize the stamp user there have been developed in the past various stamp containers which typically take the form of a closed box with the attendant cost and complexity. Inexpensive stamp dispensers to be used for segregating stamps of various denominations are therefore both desired and necessary in the marketplace and it is to that end that the present invention is directed.

SUMMARY OF THE INVENTION

Accordingly it is the general purpose and object of the present invention to provide a stamp dispenser conformed out of a single strip.

Other objects of the invention are to provide a stamp dispenser secured to a hangar plate for convenience in use.

Yet additional objects of the invention are to provide a stamp dispenser which by virtue of its structure is inexpensive and convenient in use.

Briefly these and other objects are accomplished within the present invention by providing a flat hangar plate generally rectangular in plan form and including a hole proximate one end thereof, the hangar plate being attached to a dispensing structure achieved by convolving a plastic or metal strip. More specifically, the dispensing structure comprises a rectangular strip bent over proximate the ends thereof to align end segments in substantial inwardly inclined disposition, the end segments at their curvatures defining an interior dimension smaller than the dimension of the stamp. Thus stamps may be folded in accordian-like manner and inserted into the interior defined by the end segments to be withdrawn, one by one therefrom.

BRIEF DESCRIPTION OF THE DRAWING

FIG. 1 is a perspective illustration of a stamp dispenser constructed according to the invention herein;

FIG. 2 is a top view of the inventive stamp dispenser shown in FIG. 1;

FIG. 3 is a side view of the stamp dispenser disclosed herein, illustrating the placement of the stamps on the interior thereof; and FIG. 4 is yet another side view of the stamp dispenser disclosed herein illustrating the withdrawal sequence of stamps from the interior thereof.

DESCRIPTION OF THE SPECIFIC EMBODIMENT

As shown in FIGS. 1–3 the inventive stamp dispenser, generally designated by the numeral 10, comprises a flat, generally rectangular base plate 11, provided with a hole or opening 12 proximate one end thereof to function as a hangar. Attached to one service of base plate 11 is a dispensing structure generally shown by the numeral 15, the dispensing structure again comprising a rectangular strip convolved to include two spaced transverse bends 16 and 17 around which the end segments 18 and 19 of the strip are turned to a partly overlapping alignment. Thus end segments 18 as it extends from the bend 16 aligns partly over the strip forming the structure 15 being inclined relative thereto to form a gap with the opposing edge of segment 19 through which stamps may be withdrawn. More specifically, as shown in FIG. 3 the stamps F are shown collected in an accordian stack inserted into the interior between bends 16 and 17, the dimension between bend 16 and 17 being less than the dimension of the stamps and thus requiring the curling or bending of the stamp stack. To preclude the buckling of the stack stamps S in an inward direction, the structure 15 further includes a central bend or curvature 21 directed towards the gap between the end segments 18 and 19. Thus an interior cavity is defined into which the stamps may be loaded either from the side or through the top and withdrawn one-by-one according to the example shown in FIG. 4. In each instance the withdrawal of one stamp from the stamp stack S will deploy the next stamp for further withdrawal achieving the desired sequential presentation of stamps for successive uses.

The foregoing arrangement of parts may be formed out of metal or plastic material structure, in each instance very simple strip geometry leading to inexpensive production techniques, thus a dispenser can be conveniently formed which by virtue of its low cost may be utilized in plural groups to segregate stamps of various denominations in the storage departments utilized. In addition the inclusion of the base or support 11 allows for the enlargement of the visual and tactile aspects of the dispenser, thus insuring convenience in the location thereof and by the possible use of color coding the convenience in seggregating stamp denominations.

Typically stamps S are bought in strips of ten of the same denomination. These strips are then to be folded at each stamp serration to form an accordian-like stack which may be bent over the third finger of one's hand while held between the thumb and first finger. When so bent the stack may be inserted from the side for dispensing.

Obviously many modifications and changes can be made to the foregoing description without departing from the spirit of the invention. It is therefore intended that the scope of the invention be determined solely on the claims appended hereto.

What is claimed is:

1. A dispensing device for storing postage stamps folded in an accordian arrangement, comprising:

a first rectangular strip provided with an opening proximate one end thereof; and a second rectangular strip attached to said first strip and bent to form two end segments inclined towards each other to form a gap therebetween and convolved to include a central arc directed towards said gap, said arc and end segments defining a transverse cavity conformed to receive said stamps.

2. Apparatus according to claim 1 wherein:

said stamps are aligned for dispensing through said gap.

3. Apparatus according to claim 2 wherein:

said first and second strips are formed from a translucent plastic.

* * * * *